US009194558B2

(12) United States Patent
Drenten et al.

(10) Patent No.: US 9,194,558 B2
(45) Date of Patent: Nov. 24, 2015

(54) LIGHTING DEVICE HAVING LASER-EXCITED LUMINESCENT MATERIAL

(75) Inventors: Ronald Reindert Drenten, Eindhoven (NL); Marcellus Jacobus Johannes Van der Lubbe, Best (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 199 days.

(21) Appl. No.: 13/640,757

(22) PCT Filed: Apr. 11, 2011

(86) PCT No.: PCT/IB2011/051539

§ 371 (c)(1), (2), (4) Date: Dec. 6, 2012

(87) PCT Pub. No.: WO2011/128826

PCT Pub. Date: Oct. 20, 2011

(65) Prior Publication Data

US 2013/0128492 A1 May 23, 2013

(30) Foreign Application Priority Data

Apr. 16, 2010 (EP) ..... 10160192

(51) Int. Cl.

| | |
|---|---|
| ***F21V 9/16*** | (2006.01) |
| *F21K 99/00* | (2010.01) |
| *F21Y 101/02* | (2006.01) |

(52) U.S. Cl.

CPC ... *F21V 9/16* (2013.01); *F21K 9/56* (2013.01); *F21K 9/135* (2013.01); *F21Y 2101/025* (2013.01)

(58) Field of Classification Search

USPC ..... 362/647, 650, 259, 293, 84, 294

See application file for complete search history.

(56) References Cited

U.S. PATENT DOCUMENTS

| | | | | |
|---|---|---|---|---|
| 5,535,230 | A * | 7/1996 | Abe | 372/50.23 |
| 6,653,765 | B1 | 11/2003 | Levinson et al. | |
| 7,361,938 | B2 * | 4/2008 | Mueller et al. | 257/94 |
| 8,186,864 | B2 * | 5/2012 | Komazaki et al. | 362/572 |
| 2005/0269582 | A1 | 12/2005 | Mueller et al. | |
| 2008/0232084 | A1 | 9/2008 | Kon | |
| 2009/0026913 | A1 | 1/2009 | Mrakovich | |
| 2009/0152495 | A1 | 6/2009 | Naum et al. | |
| 2009/0166652 | A1 | 7/2009 | Sakai et al. | |
| 2009/0176430 | A1 | 7/2009 | Wang | |

FOREIGN PATENT DOCUMENTS

| | | | |
|---|---|---|---|
| JP | 2003515899 | A | 5/2003 |
| JP | 2009105125 | A | 5/2009 |
| JP | 2009260053 | A | 11/2009 |
| WO | 0140702 | A1 | 6/2001 |
| WO | 03107441 | A2 | 12/2003 |
| WO | 2005107420 | A2 | 11/2005 |
| WO | 2007105647 | A1 | 9/2007 |

(Continued)

*Primary Examiner* — Ismael Negron

(74) *Attorney, Agent, or Firm* — Yuliya Mathis

(57) ABSTRACT

A lighting device includes a laser providing high brightness coherent light and a light scattering element having luminescent material adapted for converting part of the light from the laser into a different wavelength, and transmitting and scattering part of the light from the laser without conversion. The lighting device may be used as the a light source in a lamp bulb or other light emission device.

11 Claims, 8 Drawing Sheets

(56) References Cited

FOREIGN PATENT DOCUMENTS

| | | | |
|---|---|---|---|
| WO | 2008027093 | A2 | 3/2008 |
| WO | 2008056292 | A1 | 5/2008 |
| WO | 2009112961 | A1 | 9/2009 |
| WO | 2010035206 | A1 | 4/2010 |

* cited by examiner

LIGHTING DEVICE HAVING LASER-EXCITED LUMINESCENT MATERIAL

FIELD OF THE INVENTION

The present inventive concept generally relates to lighting, and more particularly to a lighting device and a corresponding lamp utilizing a light source and a light scattering element comprising luminescent material to produce light.

BACKGROUND OF THE INVENTION

In recent years the development of alternative lighting devices to replace traditional incandescent lamps in different lighting applications have resulted in a number of solutions which provide white light by utilizing light emitting diodes, LEDs, in combination with luminescent materials. Luminescent materials, such as phosphors, are materials that emit light (infrared to ultraviolet) under external energy excitation. The incident energy, in the form of high energy electron, photons, or electric field, can then be re-emitted in the form of electromagnetic radiation. Incident energy in the form of radiation within a first range of wavelengths of the electromagnetic spectra is reemitted within a second range of wavelengths of the electromagnetic spectra by the luminescent material. For lighting purposes, at least the second range of wavelengths is selected within the visible range of the electromagnetic spectra. Further, in known lighting devices, to provide a high efficiency of light energy conversion, violet and blue light is utilized to excite the luminescent material. This is shown in U.S. 2009/0176430 A1, which discloses a method of making a white light source by means of arranging a suitable amount of phosphor material on a violet LED, which phosphor material is arranged to emit yellow light subsequently to absorbing violet light. Further, the yellow light is mixed with the violet light, such that a viewer perceives the mixture of blue and yellow light as a white light with a high color rendering index.

SUMMARY OF THE INVENTION

It is an object of the present invention to provide an alternative and improved lighting device and lamp with alternative lighting effects.

According to a first aspect of the invention, this and other objects are achieved with a lighting device comprising a light source for providing light, and a light scattering element arranged for receiving light from the light source. The light scattering element comprises luminescent material adapted for converting part of the provided light into a different wavelength. The light scattering element is arranged to transmit and scatter part of the provided light without conversion. The light source is a laser arranged to provide high brightness coherent light, such that upon receiving the coherent light, light being outputted from the light scattering element comprises high brightness incoherent light originating from converted light providing a sparkle lighting effect, and coherent light providing a speckle effect.

Thereby a lighting device is provided which outputs light for illumination having a dual lighting effect. By utilizing a coherent light source such as a laser, a concentrated light input, and thereby high brightness pump radiation, is provided to the light scattering element which then outputs very bright sparkling light originating from the high brightness laser light being converted by the luminescent material and reemitted in all directions. The size of the light distributions incident to and emitted from the light scattering element determines the brightness of the outputted light, and consequently the amount of high brightness (sparkling) in the outputted light. Depending on the characteristics of the light scattering element it may be beneficial to use a very small light scattering element which still is very bright and sparkling, but in many cases the light scattering element itself may be relatively big (for reasons of easy handling in manufacturing and of heatsinking), and still provide very bright and sparkling light.

The outputted light is further characterized in spikes of light beams leaving the scattering element light originating from a speckle lighting effect. A part of the laser light is outputted from the light scattering element without being converted, thus retaining its coherent properties and thereby providing the speckle lighting effect due to interference between coherent light traveling with different light paths. Here, coherence may also refer to temporal coherence, which is related to the spectral width of the laser. When the spectral width is narrow, which is a typical characteristics of a laser, speckle patterns are generated due to interference phenomena.

Providing a sparkle lighting effect and speckle lighting effect is applicable to enhance the lighting effect of candle lamp devices in chandeliers or other types of ambiance light. The speckle creates a new ambiance effect projected on a surface (wall, ceiling) and allows designers to create new atmosphere in a room.

According to an embodiment of the lighting device, the degree of transmitted coherent light is controlled by arranging the light scattering element to have at least one of a predetermined degree of light scattering, a predetermined dopant concentration in the luminescent material, and a predetermined thickness of the light scattering device.

Thereby, a range of lighting effects varying from high sparkle lighting effect with low speckle lighting effect, to low sparkle lighting effect (brightness) with high speckle lighting effect of the lighting device is obtainable. This control over the light emission of the lighting device allows a great freedom of design and setting of ambiance light.

According to an embodiment of the lighting device, the light source and the light scattering element are separated a predetermined distance from each other, which is advantageous when a high power light source is utilized to provide a high brightness of the outputted light from the lighting device. The light source and the light scattering element may be arranged with separate cooling by means of e.g. an active or passive heat sink.

Further, when the light source, i.e. the laser, and light scattering element, e.g. a phosphor tile, are separated (remote), this gives an impression of a floating light output from the lighting device as compared to a LED-source where the phosphor tile is stacked directly on the LED. Using a laser as a light source its light output can be efficiently collected and focused on to the light-scattering element. A remote distance between the laser source and phosphor material can be enlarged which provides design freedom. The design freedom has a feature that the light-scattering element, when placed at a distance, can be viewed from many directions, having the advantages that (a) a larger fraction of the emitted light is effectively used, and that (b) the lamp will have a "distinctive look".

According to an embodiment of the lighting device, the lighting device further comprises a lens arranged between the light source and the light scattering element. Thus, the coherent light beam from the light source is advantageously controlled by means of the lens, which is arranged in the light beam path. Focusing the light beam onto the light scattering element is advantageous for some embodiments of the lighting device, since this provides that all the light energy enters the light scattering element within a predetermined area, thereby providing a very bright spot. Further, the lens may alternatively be used to defocus the light beam such that a desired beam area with a desirable light intensity of the provided light is selected.

Further, the control of the light beam by means of the lens is advantageous in other embodiments of the lighting device, in which the shape of the light scattering element may be selected such that a coherent light beam having a certain size of the spot area is desirable.

According to an embodiment of the lighting device, the brightness of the outputted light is controlled by means of the lens by focusing or determining the degree of defocus of the light entering the light scattering element.

Focusing/defocusing of the laser beam, mainly determines the brightness (cd/m$^2$) of the light distribution in the light scattering element. Thereby, the light source, e.g. the laser, may be kept at a constant power level, providing the same amount of coherent light, while the lens is utilized to control the brightness of the light outputted from the lighting device.

According to an embodiment of the lighting device, the luminescent material is a phosphor.

According to an embodiment of the lighting device, the phosphor is excitable in the UV-blue-green region within a range of wavelengths from 380 to 520 nm.

According to an embodiment of the lighting device, the light scattering element is a ceramic plate comprising at least one of YAG:Ce, LuAG:Ce, SSONe, and eCAS phosphor powder.

According to an embodiment of the lighting device, the ceramic plate is polycrystalline and the degree of scattering of the ceramic plate is selected by applying predetermined sintering conditions during manufacturing.

According to an embodiment of the lighting device, the ceramic phosphor plate or tile is a LUMIRAMIC® tile. The ceramic phosphor plate or tile (i.e. sintered phosphor) is advantangeous because of its high thermal conductivity. The high brightnesses generated in the light scattering element requires good cooling which may be obtained e.g, by proper mounting on to a metal or ceramic heat sink.

According to an embodiment of the lighting device, the light scattering element is U-shaped or tubular, or shaped like one of a plate, a cube, and a rectangular solid.

According to an embodiment of the lighting device, the light source provides blue, ultraviolet light, or green light.

According to a second aspect of the invention, there is provided a lamp comprising a lighting device according to the present inventive concept, a socket for providing power to the light source, a heat sink onto which the light scattering element is mounted, and a lamp bulb being engaged with the socket and encompassing the lighting device. The lamp socket may further be retrofitted such that the lamp can replace incandescent light bulbs in existing luminaires.

According to an embodiment of the lamp, the lamp further comprises shielding for spatially limiting the distribution of light from the lamp.

According to an embodiment of the lamp, the lamp further comprises reflecting elements.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Embodiments of the present inventive concept will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout.

Figure 1:
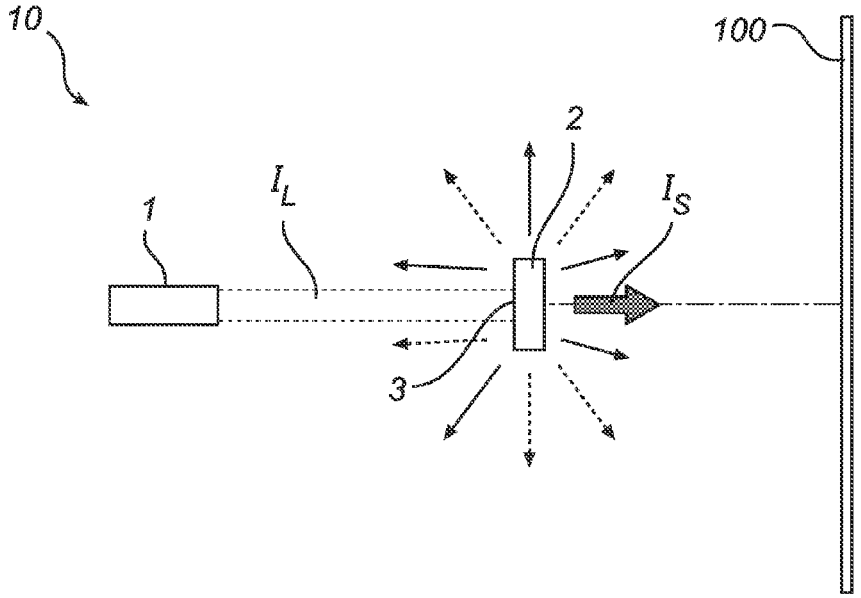
FIG. 1 is a schematic illustrative side view of an embodiment of a lighting device according to the present inventive concept.

With reference to FIG. 1, which is a schematic illustration of an embodiment of a lighting device 10 according to the present inventive concept, a coherent light source 1, such as a blue laser, and a light scattering element 2, such as a phosphor coated transparent substrate, are positioned on a suitable support (not shown). The transparent substrate may be a slab of glass, plastic, or a ceramic. Further, the phosphor material may be embedded, or dispersed, within the transparent substrate. The phosphor material of the light scattering element 2 is selected so as to convert light from the light source from the initial wavelength(s) to light of longer wave length(s). That is the phosphor material absorbs at least part of the light provided from the lights source, and subsequently emits light within a longer and preferably visible range of wavelengths. The outputted wavelength(s) is here depending on which identity and amount of phosphor material is utilized, and further on the composition of the phosphor material. The phosphor material may include only a single phosphor, or compositions of two or more phosphors to obtain a desired color of the outputted light.

Light which is emitted by the light source 1 is illustrated by light beam $I_L$, in the figures. For simplicity, in the following examples the light source is assumed to emit a single UV-blue wavelength $\lambda_L$. The light divergence of the laser beam is elliptic 5/25 deg full angle (depending on type of laser). Due to this divergence the coherent beam spot becomes larger if the distance of the light scattering element 2 to the laser source is selected to be a longer distance. With that larger spot of the incident light beam (mm$^2$) the brightness (cd/mm$^2$) becomes less. The light beam $I_L$ impinges on the light scattering element 2, and part of the received light is converted to a longer wavelength $\lambda_P$ by the phosphor material providing a sparkle lighting effect from the luminescent material. The converted light is emitted in all directions, and is illustrated by the dashed arrows in FIG. 1. In addition, some of the light beam $I_L$ is scattered in all directions as blue light of wavelength $\lambda_L$, as is illustrated by solid arrows in FIG. 1. The scattered light is mixed and when selecting the phosphor such that $\lambda_P$ is yellow, the proper combination of yellow and blue light is perceived as white light to a viewer.

Furthermore, the light scattering element 2 is arranged such that part of the incoming light beam $I_L$, i.e. light of blue wavelength $\lambda_L$, is transmitted through the light scattering element 2, and keeps its coherent properties, such that at a surface e.g. on a screen 100 which is illuminated with the light outputted in the forward direction, a speckle pattern is visible. Speckle is exhibited by a coherent imaging modality and results from the coherent addition of multiple light waves of different phases. The appearance of the speckle pattern is granular or mottled appearance. The speckle pattern is a result from low scattering of multiple waves in the forward direction from within the volume (and/or surfaces) of the light scattering element 2. The speckle pattern provides a speckle lighting effect to the light outputted from the lighting device 10, increasing the viewing experience for the viewer. Further, the speckle lighting effect may be achieved also in other directions since the light scattering element may scatter coherent light in all direction. The speckle lighting effect occurs as spikes (vs. angle) in the emitted light distributions. The speckle lighting effect may arise due to the narrow spectral width of the laser light source.

In embodiments of the lighting device, phosphor material excitable in the UV-blue-green region within a range of wavelengths from 380 to 520 nm is applicable.

Further, as will be described herein under, the phosphor coated or phosphor dispersed transparent substrate can be replaced with a transparent or translucent luminescent ceramic, particularly a so-called LUMIRAMIC® tile. Luminescent ceramic tiles are ceramic phosphor converter plates which convert the blue light of a blue LED into another color, e.g. yellow or red. A luminescent ceramic tile, such as the LUMIRAMIC® tile is manufactured by sintering high-purity phosphor powders into a solid ceramic. During this process the color point and lumen output of the luminescent ceramic tile are fixed. The sintering process may be very accurately controlled, such that fine-tuning of the concentration of ions that convert the light, e.g. the degree of dopant in the material, and the scattering of light in the plate is obtainable during the manufacturing process. The luminescent ceramic behaves as tightly packed individual phosphor particles providing scattering of the light through small optical discontinuities at the interface of different phosphor particles. For more information on luminescent ceramic tiles, see U.S. 2005/0269582 A1.

Utilizing a luminescent ceramic tile, such as the LUMIRAMIC® tile, as the light scattering element is preferred because of its high thermal conductivity. The high brightnesses generated in the light scattering element 2 require good cooling, i.e. proper mounting on to a metal or ceramic heat sink and the mentioned good thermal conductivity.

Further, the thickness of the luminescent ceramic tile will determined the amount of light that is transmitted, absorbed and emitted through photoluminescence in the tile, and the amount of light that is scattered within the tile. The selection of the degree of brightness, i.e sparkling lighting effect, vs speckle lighting effect to achieve from the light scattering element must be selected in accordance with the desired application area of the lamp. Further, a low brightness will not produce a strong sparkle lighting effect, but a too high brightness can be irritating when viewed from a short distance.

Examples of luminescent ceramic tiles that are applicable to the present inventive concept are tiles comprising Cerium-doped Yttrium aluminium garnet, YAG:Ce (yellow/white), Cerium-doped Lutetium Aluminum Garnet, LuAG:Ce (green/yellow/white), Sr0.98Si2O2N2IEu0.02, SSONe (green), or eCAS (red).

The light source of the light emitting device may in principle be realized by any suitable technology for providing coherent light. It is preferably a coherent UV, blue, or green light source. The property of a laser in respect to the brightness (cd/m2) is that the light of a laser is concentrated in a very small surface, and has an about 100 times higher brightness with respect to power output, than a Laser LED with the same power output. With this high brightness, the outputted light of a luminescent ceramic is sparkling.

A light source such as a semiconductor laser (e.g. a side-emitting laser or VCSEL) generally produce a divergent output beam. A lens can be used to convert the divergent beam into a parallel or convergent beam. By choosing the lens design (e.g. focal distance f and aberrations) and its distance to the light source (laser) and the light scattering element, the size and shape of the (coherent light) light distribution incident at the light scattering element can be controlled, e.g. be varied from very bright and concentrated to more extended and less bright (in terms of W/m2 incident to, or measured as brightness cd/m2 emitted from the light scattering element). The brightness of the luminescence from the light scattering element (i.e. the incoherent light) will also increase or decrease when the brightness of the incident light increases or decreases, respectively. Further, the resulting brightnesses of the backward and forward emitted luminescence and pump radiation are not only determined by the lens design and position but also by the thickness, scattering, and doping concentrations of the luminescent ceramic/phosphor used as the light scattering element.

Figure 2:
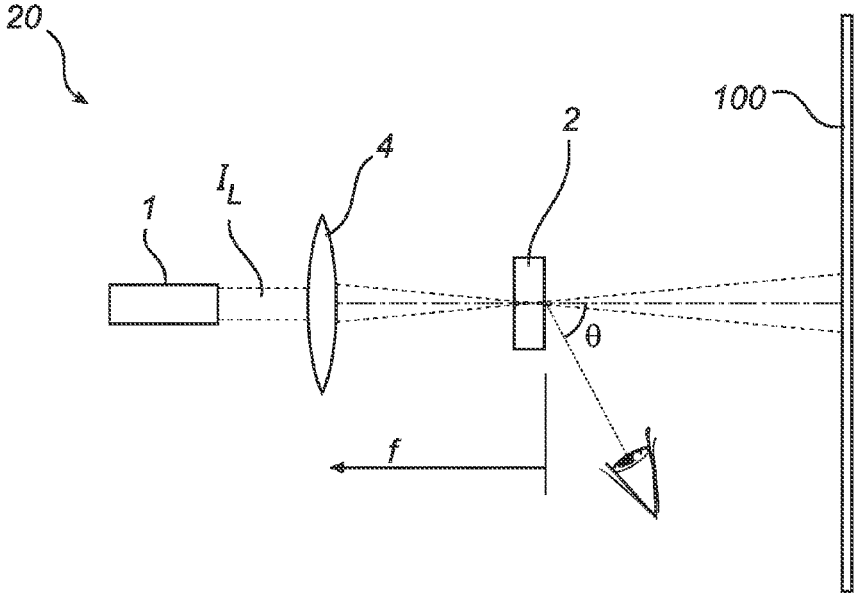
FIG. 2 is a schematic illustrative side view of an embodiment of a lighting device according to the present inventive concept.

As illustrated in FIG. 2, an embodiment of the lighting device 20 in addition to the light source 1, which here is a blue laser, wavelength 445 nm light, and the light scattering element 2, a 1 mm2×120 μm YAG:Ce luminescent ceramic tile designed for wavelength converting coherent blue light, further comprises a lens 4, such as a AC-296 (f=3 mm) by Philips Optics (now Anteryon). To control the brightness of the light beam IL as it reaches the light scattering element 2, the lens 4 is arranged to shape the beam and focus it on the light scattering element 2.

Figure 3A:
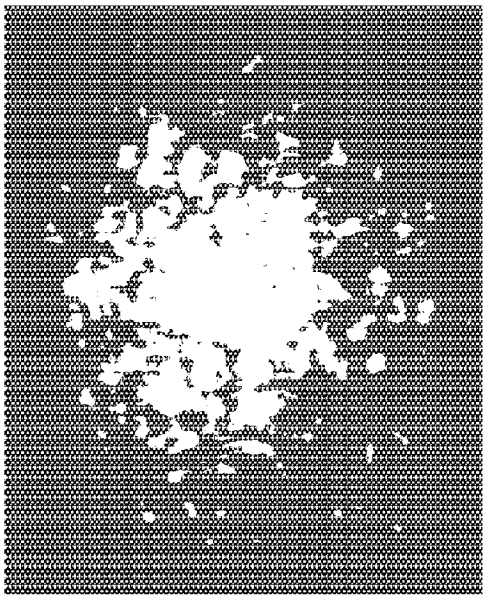
FIGS. 3*a*-3*c* are exemplifying illustrations of the intensity distribution in the forward direction from an embodiment of a lighting device according to the present inventive concept as a function of different defocusing of the light beam entering the light scattering element.

Focusing, and defocusing, of the light beam $I_L$ gives the effect of achieving different speckle patterns for the same light scattering element 2. In FIG. 2 a screen 100 is arranged 2 m from the lighting device 20 and the lens 4 is arranged a distance equal to its focal length minus the thickness of the light scattering element 2, i.e. the light beam is slightly defocused with respect to the light scattering element. By repositioning of the lens 4, different degrees of defocusing of the light beam is allowed. FIG. 3*a* illustrates the resulting light distribution as the outputted light from the lighting device 20 is projected onto the screen 100, when arranging the lens 4 as to focus the laser beam $I_L$ onto the light scattering element 2, defocus of the laser beam is 0.

Figure 3B:
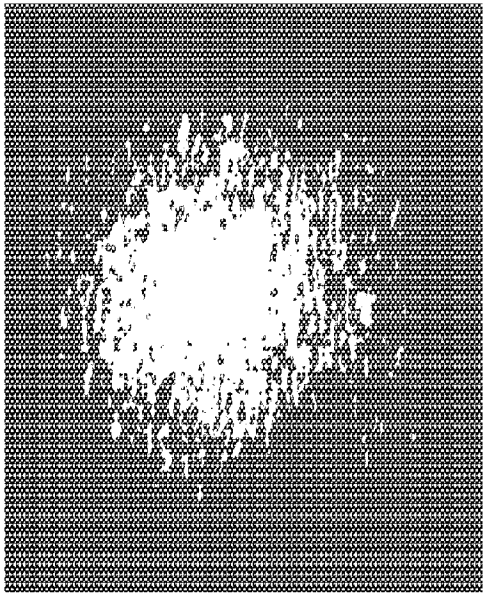
Figure 3C:
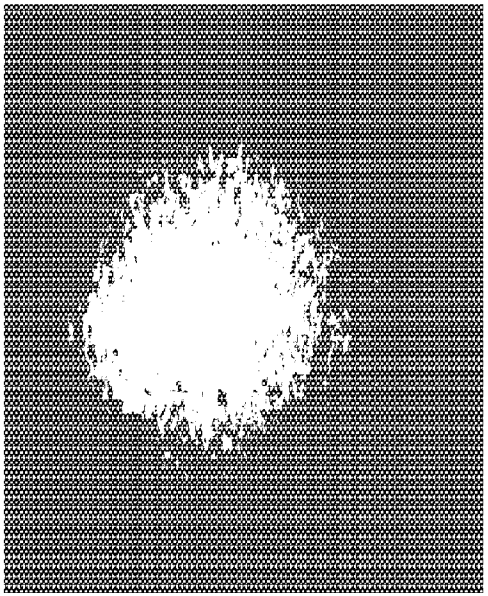

By choosing the lens design and distance to the light source and light scattering element not only the brightnesses, but also the characteristics of the (transmitted and reflected) speckle patterns are influenced. This is illustrated in FIGS. 3 *a*-3 *c*. When the lens design and its position with respect to the light source and the Luminescent ceramic/phosphor are chosen to produce a high brightness, the speckle patterns are relatively coarse (FIG. 3 *a*). But when a lower brightness is produced the speckle patterns are relatively fine (FIG. 3 *c*). In FIG. 3 *b*) the lens is arranged such that the laser beam IL is defocused 5 mm from the light scattering element 2, wherein the laser light energy per input area is decreased and the produced speckle pattern on the screen is more fine than FIG. 3 *a*. Further, FIG. 3 *c*) illustrates how an even finer speckle pattern is achieved when defocusing the light beam IL 50 mm. This effect is caused by the diffraction of the beam in the light scattering element.

A viewer viewing the outputted light in an angle θ, will with the present inventive concept experiencing varying colour of the outputted light under different viewing angles. Light spread backwards from the light scattering element 2, with respect to the traveling direction of the light beam is typically the resulting light of light originating from scattering of the laser light and converted light, i.e. white light when the laser light is blue and the converted light is yellow, while light in the forward direction, depending on the degree of transmitted coherent light, is blue. Depending on the type of luminescent ceramic more or less coherent light is scattered in the luminescent ceramic. Luminescent ceramic with low scattering behavior passes through more coherent blue light which is viewed in the forward direction. Depending on the angle of view, the influence of the scattered light beam takes over and a more yellow/white light is experienced. The effect is known as Color over angle.

With a high scattering luminescent ceramic material less coherent blue light passes resulting in a low forward coherent blue light beam. In this case only a yellow/white light beam is viewed.

Figure 4A:
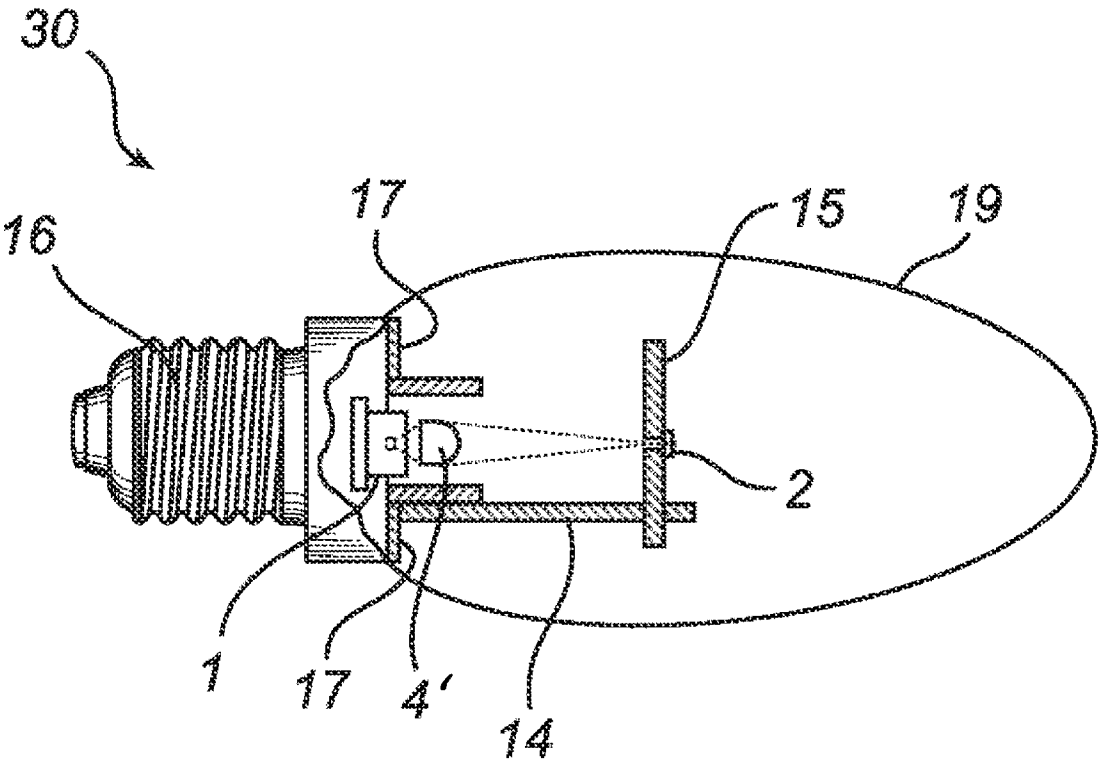
FIGS. 4*a* and 4*b* are partly cut-open side views of embodiments of a lamp according to the present inventive concept.

Referring now to FIG. 4 *a*) a lighting device according to the present inventive concept is arranged in a lamp 30. A light source 1, such as a λL 445 nm laser is fixed in an aluminum housing which acts as a heatsink for the laser. The lamp 30 comprises a socket 16 for connecting the lamp 30 to the main voltage of the electricity net. The lamp further comprises a driver (not shown) for converting the main voltage to a voltage and current suitable for the light source 1, such that the light source 1 is provided with electrical power when the lamp 30 is activated. Further, in a distance of proximately 3 mm an AC296 focus lens 4' is placed in front of the laser and a luminescent ceramic tile is positioned in an 010 mm Cu fixture plate acting as a heat sink 15. The heat sink 15 is of 0.5 mm thickness and is arranged at a distance of 25 mm in front of the lens 4. The lens 4' is arranged to focus the light beam generated by the laser onto the luminescent ceramic tile. The heat sink 15 has a ϕ0.5 mm diaphragm hole to pass the laser beam provided by the laser.

A glass bulb 19 encompasses the arrangement described above, and is of a CFL candle lamp, even as the socket 16 which is a E14 fitting.

The light scattering element 2 is arranged on the heat sink 15, such that heat, which is created as the laser light impinges the light scattering element 2, can be dissipated. The heat sink 15 is arranged on a support 14, which further is arranged to position the light scattering element a predetermined distance from the light source 1 and the lens 4*a*.

The light scattering element 2 and the laser are separated such that light being outputted from the light scattering element may be scattered and emitted backwards towards the laser.

Reflecting elements 17 are arranged to direct backscattered light in the forward direction thus increasing the amount of light in the forward direction.

Figure 4B:
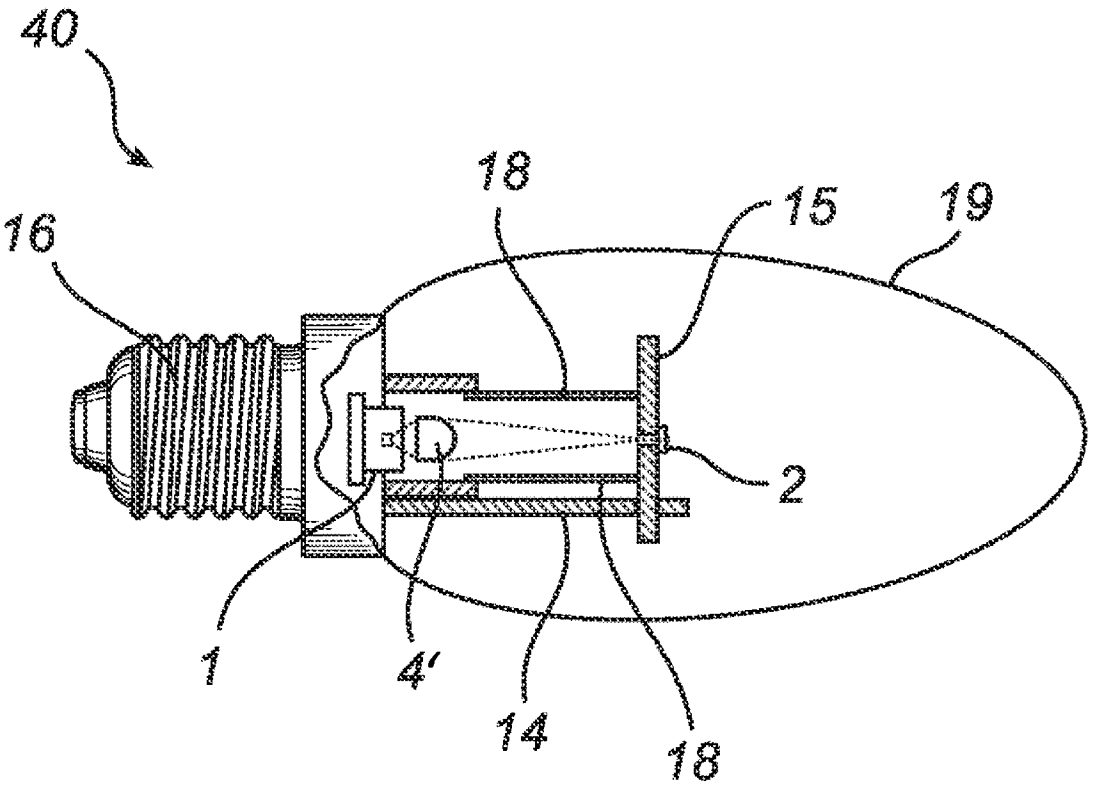
Figure 5A:
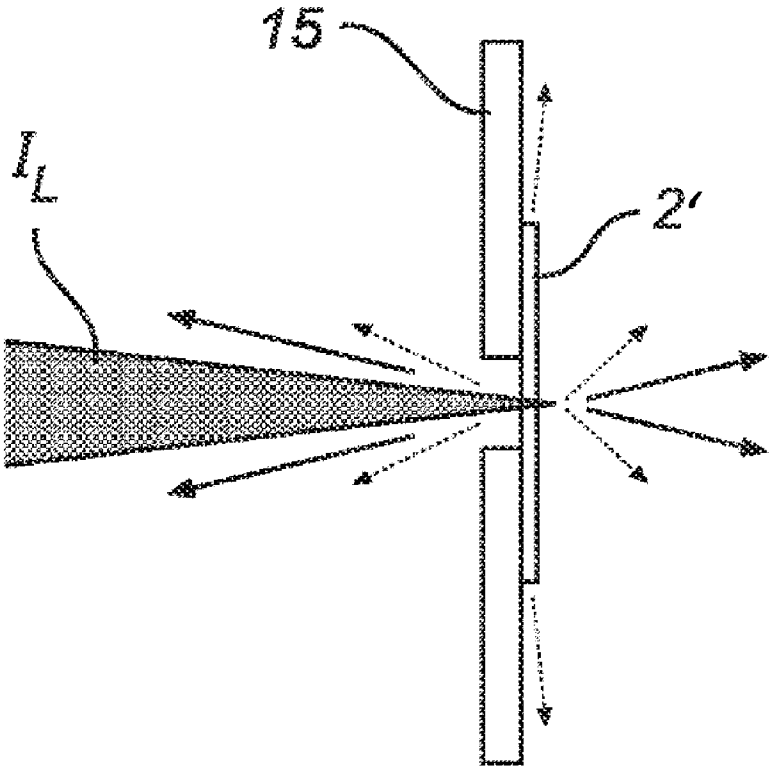
FIGS. 5*a*-5*d* are schematic cross-sectional side views of different shapes of the light scattering element in embodiments of a lighting device according to the present inventive concept.
Figure 5B:
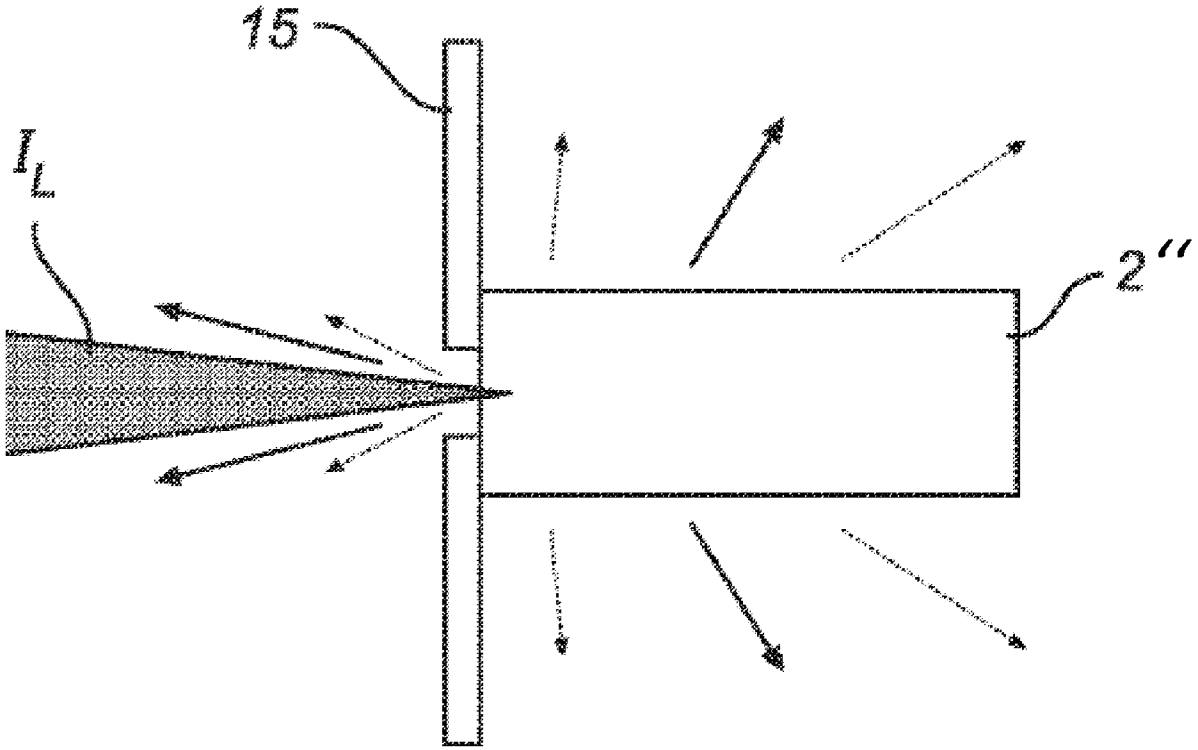
Figure 5C:
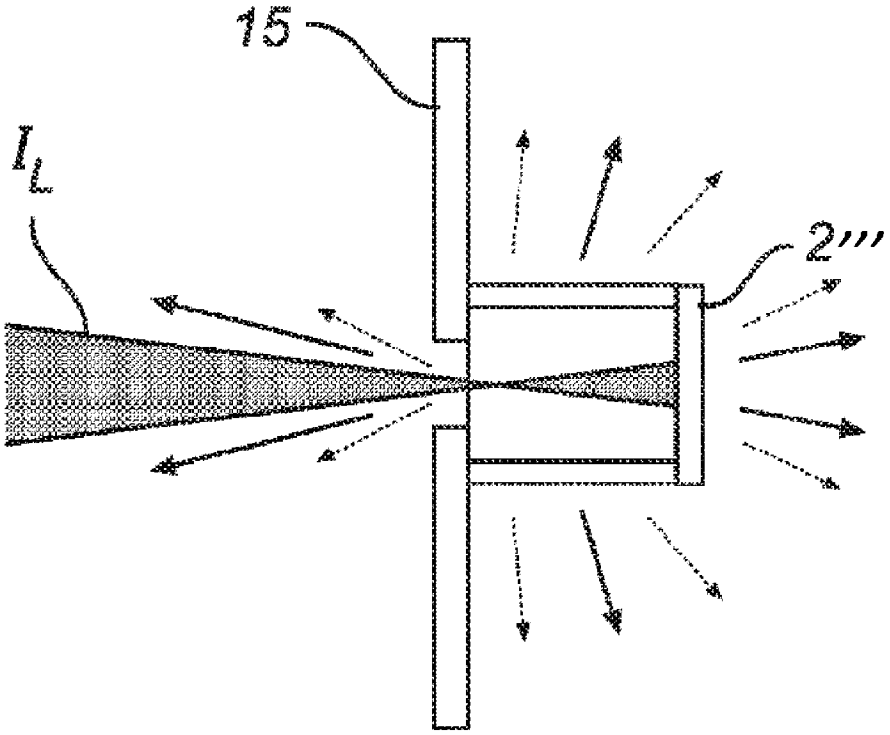
Figure 5D:
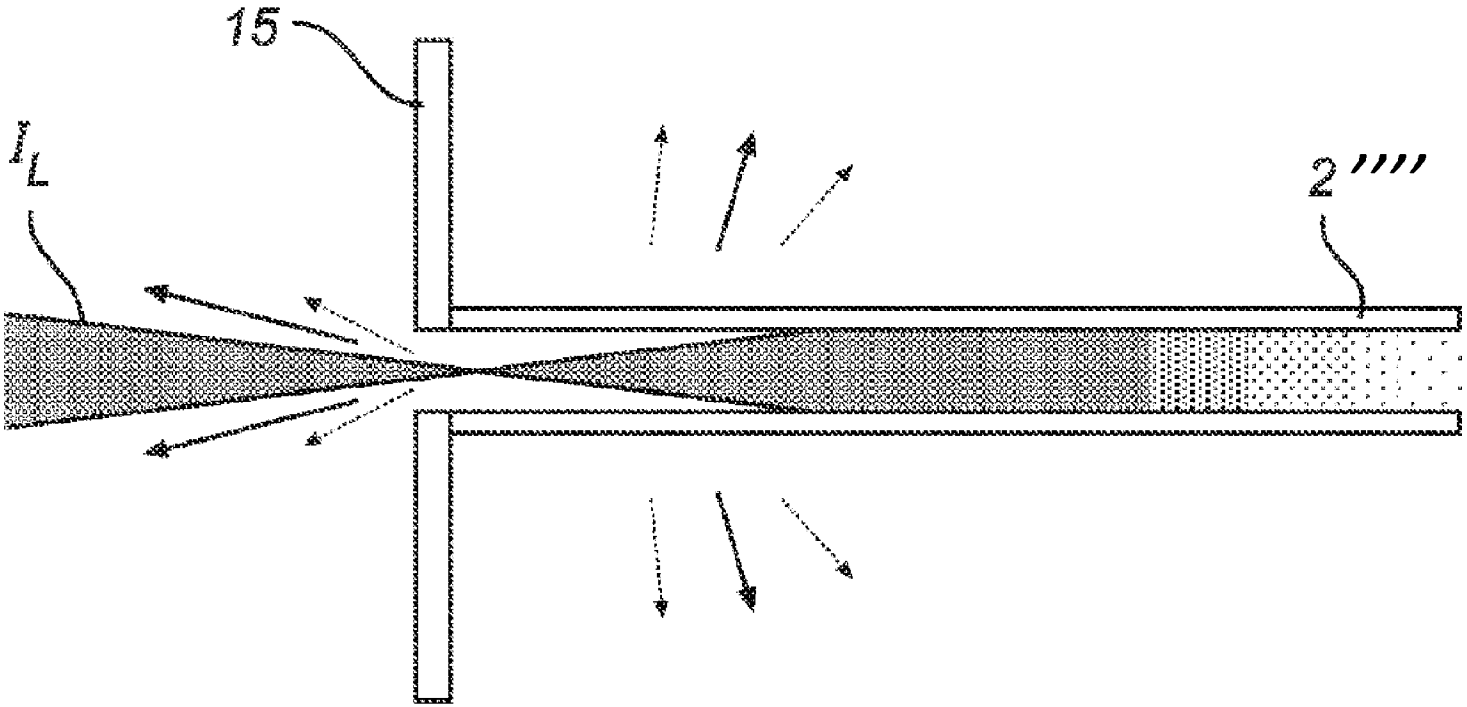

When arranging the light scattering element in a heat sink having a narrow through hole typically most of the backscattered light is shielded by the heat sink. If further limitation of light in the backwards direction is desired for the specific lighting application, such as in case of a spot light where only high brightness is desired and the blue speckle effect is not required, additional shielding 18 can optionally be provided, as illustrated in FIG. 4*b*). The shielding can be arranged to shield off light outputted from the lighting device in any desirable direction limiting the distribution of light from the lamp depending on the specific application.

The light scattering element 2 is a luminescent ceramic YAG:Ce. The concentration of the active dopant (Ce in the case of YAG:Ce), the degree of scattering which is determined by the sintering conditions, and the thickness of the luminescent ceramic tile is utilized to control the degree of scattered light, converted light, and transmitted light being outputted from the lamp. As previously described part of the blue laser beam is transmitted through the light scattering element 2. A high degree of transmitted coherent light is achievable with a low scattering degree, a low dopant degree, and/or a low thickness of the light scattering element, or a combination of the three.

The light scattering element 2 may be arranged having a high degree of scattering which results in less transmitted coherent light and a more homogenous yellow, or white appearance of the light also in the forward directions. The lower degree of transmitted coherent light is an effect of high scattering degree, a high dopant concentration, and/or a high thickness, or a combination of the three.

FIGS. 5*a*-5*d* are schematic cross-sectional side views of different shapes of the light scattering elements (2', 2", 2'", 2", respectively) in embodiments of a lighting device according to the present inventive concept. These shapes provide a secondary point of entrance for the backscattered light beam.

Part of the coherent light beam is absorbed in the luminescent ceramic tile, while part of the coherent light beam passes the luminescent ceramic tile. Further, a part of the coherent light beam is reflected by the luminescent ceramic tile back to where it came from, only over a 180'angle (back scattering). The back scattered coherent light can be used again to enforce the luminescent light spot (sparkle spot). Using a U-shape cube (FIG. 5 *c*) firstly light is focused on the top luminescent ceramic tile where primarily the coherent light beam is absorbed by the luminescent ceramic tile. The back scattered coherent light meets the vertical walls of the U-shape cube, where the coherent light beam can make a second entry of a luminescent ceramic tile to convert into the desired wavelength. In this case the conversion efficiency of the blue coherent laser light in the light scattering element is improved. Other shapes with the same purpose are applicable (FIG. 5 *b* and FIG. 5 *d*). The tubular/cylindrical shape (FIG. 5 *d*) can provide a more filament like shape known from an incandescent lamp. The tubular shape creates more design freedom.

Further, the geometry of the light scattering element, which has been exemplified above, with reference to FIGS. 5*a*-5*d*, can be chosen to select the luminance (cd/$m^2$) visible to the eye, and the preferably to avoid a too high luminance, which is perceived as "glare" rather than sparkle, the latter which is one of the objects to achieve with the present inventive concept. The sparkle lighting effect desirable for use in lighting devices or candle lamps in applications like chandeliers.

The person skilled in the art realizes that the present invention by no means is limited to the preferred embodiments described above. On the contrary, many modifications and variations are possible within the scope of the appended claims.

The invention claimed is:

1. A lighting device comprising:

a light source for providing light;

a light scattering element arranged for receiving light from said light source;

a socket for providing power to said light source;

a heat sink onto which said light scattering element is mounted and separated from the light source by a support;

a lamp bulb being engaged with said socket and encompassing said lighting device;

said light scattering element comprising luminescent material adapted for converting part of said provided light into a different wavelength, wherein said light scattering element is arranged to transmit and scatter part of said provided light without conversion, wherein said light source is a laser arranged to provide high brightness coherent light, such that upon receiving said coherent light, light being outputted from said light scattering element comprises high brightness incoherent light originating from converted light providing a sparkle lighting effect, and coherent light providing a speckle lighting effect;

wherein the degree of transmitted coherent light is controlled by arranging said light scattering element to have at least one of a predetermined degree of light scattering, a predetermined dopant concentration in said luminescent material, and a predetermined thickness of the light scattering device;

wherein said light source and said light scattering element are separated a predetermined distance from each other.

2. The lighting device according to claim 1, further comprising a lens wherein the brightness of the outputted light is controlled by means of said lens by determining the degree of defocus of the light entering said light scattering element.

3. The lighting device according to claim 1, wherein said light scattering element is U-shaped or tubular, or shaped like one of a plate, a cube, and a rectangular solid.

4. The lighting device according to claim 1, wherein said light source provides blue, ultraviolet light, or green light.

5. A lamp according to claim 1, further comprising shielding for spatially limiting the distribution of light from the lamp.

6. A lamp according to claim 1, further comprising reflecting elements.

7. The lighting device according to claim 1, wherein said luminescent material comprises a phosphor.

8. The lighting device according to claim 7, wherein said phosphor, is excitable in the UV-blue-green region within a range of wavelengths from 380 to 520 nm.

9. The lighting device according to claim 1, wherein said light scattering element is a ceramic plate comprising at least one of YAG:Ce, LuAG:Ce, SSONe, and eCAS.

10. The lighting device according to claim 9, wherein said ceramic plate is polycrystalline and the degree of scattering of said ceramic plate is selected by applying predetermined sintering conditions during manufacturing.

11. A lighting device comprising:

a light source for providing light combined with a lens;

a light scattering element separated from the light source and arranged for receiving light emitted from said light source;

said light scattering element including a luminescent material, the luminescent material converting part of the received light into a different wavelength;

the light scattering element arranged on a heat sink to transmit and scatter part of the provided light without conversion;

wherein the light source is a laser, the laser arranged to provide high brightness coherent light such that upon receiving the coherent light, light being outputted from said light scattering element includes:

high brightness incoherent light originating from converted light providing a sparkle lighting effect, and coherent light providing a speckle lighting effect;

wherein the degree of transmitted coherent light is controlled by arranging the light scattering element to have at least one of a predetermined degree of light scattering, a predetermined dopant concentration in said luminescent material, and a predetermined thickness of the light scattering device;

the light scattering element is a ceramic plate comprising at least one of YAG:Ce, LuAG:Ce, SSONe, and eCAS;

the ceramic plate is polycrystalline and the degree of scattering of said ceramic plate is selected by applying predetermined sintering conditions during manufacturing.

* * * * *